US006761174B2

(12) United States Patent
Jupe et al.

(10) Patent No.: US 6,761,174 B2
(45) Date of Patent: Jul. 13, 2004

(54) CIGARETTE AND FILTER WITH DOWNSTREAM FLAVOR ADDITION

(75) Inventors: Richard Jupe, Richmond, VA (US); Ronald William Dwyer, Glen Allen, VA (US); Don Earl Laslie, Midlothian, VA (US); Arlington L. Finley, Midlothian, VA (US); Barbara G. Taylor, Midlothian, VA (US); Cecil M. Smith, Disputanta, VA (US); Vivian E. Willis, Maidens, VA (US)

(73) Assignee: Philip Morris Incorporated, New York, NY (US)

( * ) Notice: Subject to any disclaimer, the term of this patent is extended or adjusted under 35 U.S.C. 154(b) by 22 days.

(21) Appl. No.: 10/080,801

(22) Filed: Feb. 22, 2002

(65) Prior Publication Data

US 2002/0166563 A1 Nov. 14, 2002

Related U.S. Application Data

(60) Provisional application No. 60/270,698, filed on Feb. 22, 2001, and provisional application No. 60/292,426, filed on May 21, 2001.

(51) Int. Cl.[7] ..... A24D 3/04

(52) U.S. Cl. ..... 131/335; 131/336; 131/341; 131/342; 131/344; 131/202; 131/201; 131/331

(58) Field of Search ..... 131/360, 200, 131/201, 202, 203, 331, 335, 336, 339, 340, 341, 342, 344; 162/139

(56) References Cited

U.S. PATENT DOCUMENTS

| | | | | |
|---|---|---|---|---|
| 2,881,770 A | | 4/1959 | Touey | |
| 3,101,723 A | | 8/1963 | Seligman et al. | |
| 3,353,543 A | | 11/1967 | Sproull et al. | |
| 3,894,545 A | | 7/1975 | Crellin et al. | |
| 4,281,671 A | | 8/1981 | Bynre et al. | |
| 4,357,950 A | | 11/1982 | Berger | |
| 4,481,958 A | | 11/1984 | Rainer et al. | |
| 4,614,199 A | | 9/1986 | Berger | |
| 4,675,064 A | | 6/1987 | Berger | |
| 5,261,425 A | * | 11/1993 | Raker et al. | 131/365 |
| 5,263,999 A | | 11/1993 | Baldwin et al. | |
| 5,404,890 A | | 4/1995 | Gentry et al. | |
| 5,568,819 A | * | 10/1996 | Gentry et al. | 131/342 |
| 5,997,691 A | | 12/1999 | Gautam et al. | |

* cited by examiner

*Primary Examiner*—Dionne A. Walls
(74) *Attorney, Agent, or Firm*—Connolly Bove Lodge & Hutz LLP

(57) ABSTRACT

A cigarette comprises a tobacco rod and a multi-component filter comprising a bed of adsorbent and a flavor-releasing filter segment located downstream of the bed of adsorbent. In the preferred embodiment, the adsorbent is also flavor-bearing and comprises high surface area, activated carbon. As mainstream smoke is drawn through the upstream portion of the filter, gas phase smoke constituents are removed and flavor is released from the adsorbent bed. Thereafter additional flavor is released into the mainstream smoke as it passes through the flavor-releasing filter segment. Ventilation is provided to limit the amount of tobacco being combusted during each puff and is arranged at a location spaced downstream from the adsorbent bed to lower mainstream smoke velocity through the adsorbent bed. Preferably, the carbon bed comprises at least 90 to 120 mg or greater of carbon in a fully filled condition or 160 to 180 mg or greater of carbon in a 85 filled condition or better, which in combination with other features provides a flavorful cigarette that achieves significant reductions in gas phase constituents of the mainstream smoke, including 90% reductions or greater in 1, 3 butadiene, acrolein, isoprene, propionaldehyde, acrylonitrile, benzene, toluene, styrene, and 80% reductions or greater in acetaldehyde and hydrogen cyanide.

44 Claims, 6 Drawing Sheets

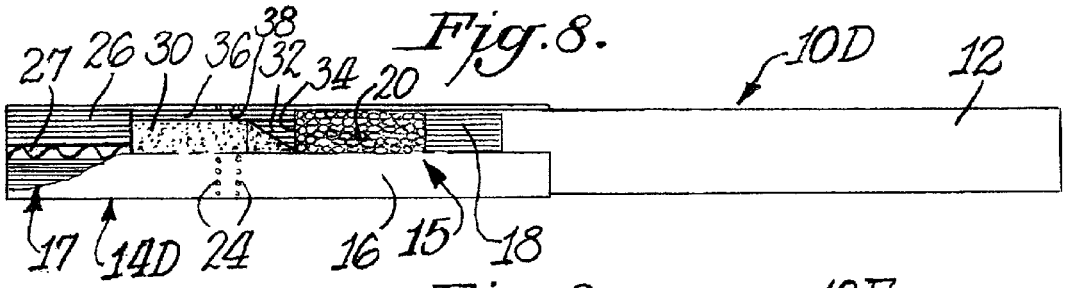
Fig. 8.
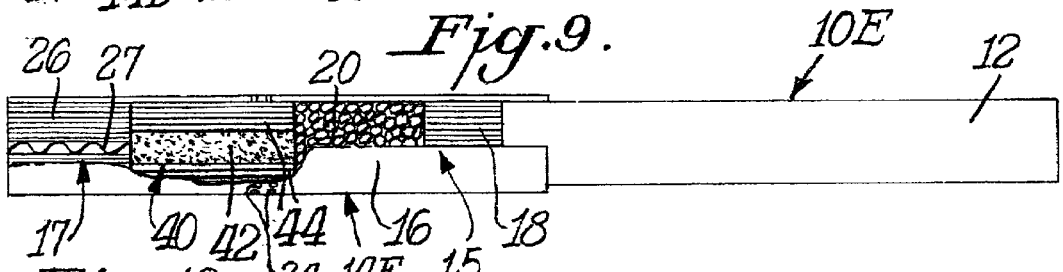
Fig. 9.
Fig. 10.
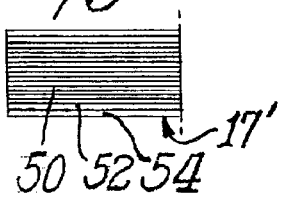
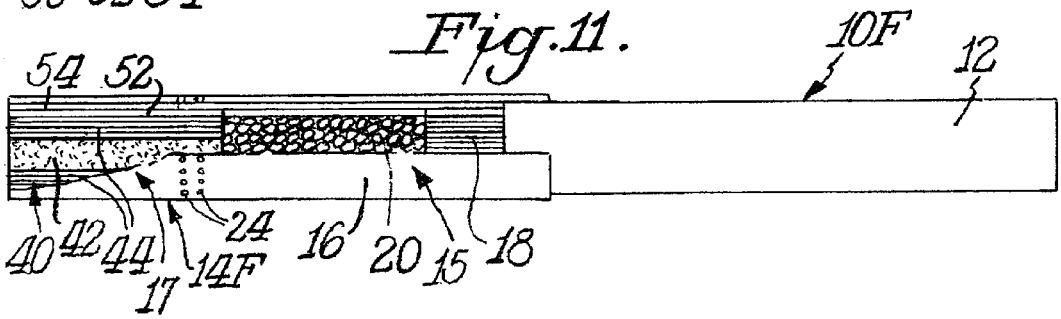
Fig. 11.

CIGARETTE AND FILTER WITH DOWNSTREAM FLAVOR ADDITION

CROSS REFERENCE TO RELATED APPLICATIONS

The present application claims the benefits of earlier filed provisional applications Serial Nos. 60/270,698 and 60/292,426 filed Feb. 22, 2001 and May 21, 2001, respectively.

FIELD OF THE INVENTION

The present invention relates to smoking articles such as cigarettes, and in particular, to cigarettes that include filter segments comprising an adsorbent and fibrous and/or web filter materials and that are configured for advantageous removal of gas phase components from mainstream smoke.

BACKGROUND OF THE INVENTION

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. Typically, the filter includes a plug of cellulose acetate tow attached to the tobacco rod by tipping paper. Ventilation of mainstream smoke is achieved with a row or rows of perforations about a location along the filter. Such ventilation provides dilution of drawn mainstream smoke with ambient air to reduce the delivery of tar.

Particulate efficiency of a filter is typically resolved as the level of tar into a filter minus tar level out of the filter divided by the tar level into the filter. Ventilation tends to lower particulate efficiency of a filter.

Upon lighting a cigarette, a smoker draws mainstream smoke from the coal at the lit end of the cigarette. The drawn cigarette smoke first enters the upstream end portion of the filter and then passes through the downstream portion adjacent the buccal (mouth) end of the cigarette.

Certain cigarettes have filter segments which incorporate adsorbent materials such as activated carbon, and examples of such are described in U.S. Pat. No. 2,881,770 to Tovey; U.S. Pat. No. 3,353,543 to Sproull et al.; U.S. Pat. No. 3,101,723 to Seligman et al.; and U.S. Pat. No. 4,481,958 to Ranier et al. Certain commercially available filters have particles or granules of carbon (e.g., an activated carbon material) alone or dispersed within a cellulose acetate tow; other commercially available filters have carbon threads dispersed therein; while still other commercially available filters have so-called "plug-space-plug", "cavity filter" or "triple filter" designs. Examples of commercially available filters are SCS IV Dual Solid Charcoal Filter and Triple Solid Charcoal Filter from Filtrona International, Ltd.; Triple Cavity Filter from Baumgartner; and ACT from Filtrona International, Ltd. See also, Clarke et al., *World Tobacco*, p.55 (November 1992). Detailed discussion of the properties and composition of cigarettes and filters is found in U.S. Pat. Nos. 5,404,890 and 5,568,819 to Gentry et al, the disclosures of which are hereby incorporated by reference.

Typical of prior practices with "plug-space-plug" styled cigarettes has been heretofore to locate ventilation at a location along the bed of adsorbent contained in the space, so as to achieve sufficient spacing of the ventilation holes from the buccal end of the filter. In so doing, the lips of the smoker would not occlude the ventilation holes. Such placement, however, tended to lower the filtration effectiveness of the adsorbent, because it tended to increase the velocity of the mainstream smoke in at least a portion of the absorbent bed.

Various annular configurations of filters having carbon-bearing annular filter regions are disclosed in the prior art. For example, European Patent Application No. 579,410 shows a number of cigarette embodiments having an annular carbon-bearing region surrounding either porous filtration material or an empty tubular cavity formed by a vapor phase porous membrane. Similarly, U.S. Pat. No. 3,894,545 to Crellin et al. shows various configurations of annular carbon-bearing regions surrounding a vapor phase porous membrane or a rod of carbon-bearing material surrounded by a vapor phase porous membrane.

Cigarette filter elements which incorporate carbon have the ability to remove constituents of mainstream smoke which passes therethrough. In particular, activated carbon has the propensity to reduce the levels of certain gas phase components present in the mainstream smoke, resulting in a change in the organoleptic properties of that smoke.

Despite these advantages of carbon bearing filters, they are not so widely employed. It has been found that mainstream smoke from carbon filters tend to have a flavor note that is contrary to consumer preferences, and that therefore their employment in commercially offered cigarettes has not been heretofore widespread.

It would be desirable to provide a cigarette having a cigarette filter incorporating carbon and/or other materials capable of absorbing and/or adsorbing gas phase components present in mainstream cigarette smoke, while providing favorable absorption/adsorption, dilution and drawing characteristics, and adding flavor to the filtered smoke so as to enhance consumer acceptability.

Furthermore, it would be desirable to provide such a filter with desirable residence time in the adsorbent/absorbent-containing region while simultaneously achieving a pressure drop downstream of the dilution region and the adsorbent/absorbent so as to provide acceptable drawing characteristics of puffs of smoke having reduced gas phase components but with acceptable taste and resistance-to-draw.

SUMMARY OF THE INVENTION

In accordance with the present invention, a smoking article such as a cigarette comprises a tobacco rod and a multi-component filter comprising a bed of adsorbent and a flavor-releasing filter segment located downstream of the bed of adsorbent. In the preferred embodiment, the adsorbent is also flavor-bearing and comprises high surface area, activated carbon. As mainstream smoke is drawn through the upstream portion of the filter, gas phase smoke constituents are removed and flavor is released from the adsorbent bed. Thereafter additional flavor is released into the mainstream smoke as it passes through the flavor-releasing filter segment. Ventilation is provided to limit the amount of tobacco being combusted during each puff and is arranged at a location spaced downstream from the adsorbent bed to lower mainstream smoke velocity through the adsorbent bed. Preferably, the carbon bed comprises at least 90 to 120 mg or greater of carbon in a fully filled condition or 160 to 180 mg or greater of carbon in a 85% filled condition or better, which in combination with other features provides a flavorful cigarette that achieves significant reductions in gas phase constituents of the mainstream smoke, including 90% reductions or greater in 1, 3 butadiene, acrolein, isoprene, propionaldehyde, acrylonitrile, benzene, toluene, styrene, and 80% reductions or greater in acetaldehyde and hydrogen cyanide.

Both the downstream flavor releasing segment and the flavor-bearing carbon bed contribute a flavor note throughout all puffs of a smoking, but the flavor contribution of the downstream segment is greater during the initial puffs than during later puffs. Conversely, the flavor contribution of the carbon bed is greater during the later puffs. Flavor delivery is therefore balanced and consistent throughout the entire smoking process.

Advantageously, the present invention addresses the desirability of achieving optimum residence times for the smoke in the regions of the filter bearing the adsorbent material while also achieving favorable dilution of the smoke with ambient air and inducing an acceptable resistance to draw as is expected by most smokers.

With the foregoing and other advantages and features of the invention that will become hereinafter apparent, the nature of the invention may be more clearly understood by reference to the following detailed description of the invention, the appended claims and to the several views illustrated in the drawing.

BRIEF DESCRIPTION OF THE DRAWING

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 8 is a side elevational view of another cigarette comprising a tobacco rod and a multi-component filter, according to the present invention, with portions thereof broken away to illustrate interior details.

FIG. 9 is a side elevational view of still another cigarette comprising a tobacco rod and a multi-component filter, according to the present invention, with portions thereof broken away to illustrate interior details;

FIG. 10 is a fragmental sectional view of a modified downstream flavor-releasing segment, according to the present invention; and FIG. 11 is a side elevational view of another cigarette comprising a tobacco rod and a multi-component filter, according to the present invention, with portions thereof broken away to illustrate interior details.

DETAILED DESCRIPTION OF THE INVENTION

Figure 1:
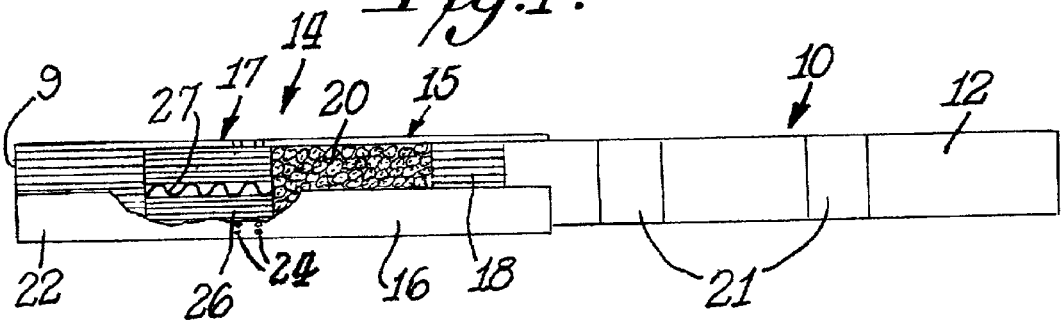
FIG. 1 is a side elevational view of a cigarette comprising a tobacco rod and a multi-component filter, according to the present invention, with portions thereof broken away to illustrate interior details.

Referring to FIG. 1, a preferred embodiment of the present invention provides a cigarette 10 comprising a rod of smokable material 12 such as shredded tobacco and a multi-component filter 14 attached to the rod 12 with a tipping paper 16. Upon lighting of the cigarette 10, mainstream smoke is generated by and drawn from the tobacco rod 12 and through the filter 14.

Herein, the "upstream" and "downstream" relative positions between filter segments and other features are described in relation to the direction of mainstream smoke as it is drawn from the tobacco rod 12 and through the multi-component filter 14.

Preferably, the filter 14 comprises a first, upstream adsorbent-bearing segment 15 and a mouth end (mouthpiece) component 22. In this first preferred embodiment, the adsorbent-bearing segment 15 comprises a plug-space-plug filter sub-assembly that includes a central filter component 17, a tobacco end component 18 in spaced apart relation to the central filter component 17 so as to define a cavity 19 therebetween, and a bed of high surface area, activated carbon material 20 disposed in the cavity 19. The tobacco end component 18 is located adjacent the tobacco rod 12 and preferably, comprises a plug of cellulose acetate tow of low resistance to draw ("RTD"). Preferably, the tobacco end component 18 is made as short as possible within the limits of high-speed machineability and preferably has the lowest particulate RTD amongst the filter components comprising the multi-component filter 14.

The mouth end (buccal) component 22 is preferably in the form of a cellulose acetate plug or other suitable fibrous or webbed material of moderate to low particulate efficiency. Preferably, the particulate efficiency is low, with the denier and grand total denier being selected such that the desired total RTD of the multi-component filter 14 is achieved.

Preferably the carbon of the adsorbent bed 20 is in the form of granules and the like. Preferably, the carbon of the preferred embodiment is a high surface area, activated carbon, for example a coconut shell based carbon of typical ASTM mesh size used in the cigarette industry or finer. The bed of activated carbon is adapted to adsorb constituents of mainstream smoke, particularly, those of the gas phase including aldehydes, ketones and other volatile organic compounds, and in particular 1, 3 butadiene, acrolein, isoprene, propionaldehyde, acrylonitrile, benzene, toluene, styrene, acetaldehyde and hydrogen cyanide. Adsorbent materials other than carbon may be used as explained below.

With respect to the carbon particles 20, it is preferred that they have a mesh size of from 10 to 70, and more preferably a mesh size of 20 to 50.

Preferably at least some, if not all of the adsorbent bed 20 is flavor-bearing or otherwise impregnated with a flavor so that the adsorbent bed 20 of the upstream adsorbent bearing segment 15 is adapted not only to remove one or more gas phase smoke constituents from mainstream smoke, but also to release flavor into the mainstream smoke stream. Preferably, flavor is added to the carbon by spraying flavorant upon a batch of activated carbon in a mixing (tumbling) drum or alternatively in a fluidized bed with nitrogen as the fluidizing agent, wherein flavorant may then be sprayed onto the carbon in the bed.

Still referring to FIG. 1, the central filter component 17 of the multi-component filter 14 preferably comprises a plug 26 of fibrous filter material, preferably cellulose acetate tow of a moderate to low particulate efficiency and RTD, together with one or more flavor-bearing yarns 27. As mainstream tobacco smoke is drawn through the central filter component 17 and along the yarn 27, flavoring is released into the stream of mainstream smoke. Flavor thread bearing filter plugs may be obtained from the American Filtrona Company, 8410 Jefferson Davis Highway, Richmond, Va. 23237-1341 and a suitable construction for the central filter component 17 is described in U.S. Pat. No. 4,281,671, which patent is hereby incorporated by reference in its entirety.

In the preferred embodiment, the central filter component 17 and its flavor yarn 27 is located downstream of the flavor-bearing, carbon bed 20. The preferred practice of the present invention includes a release of flavor from both the bed 20 of flavored carbon and the flavor yarn 27 located downstream thereof, so as to achieve a balanced, consistent delivery of tastes and aromas throughout a smoking. However, it is within contemplation of the present invention to locate flavorants on either the component 17 or the carbon bed 20, standing alone, or any of the above with addition of flavorants being carried along one or more plug wraps and/or the tipping paper 16.

Preferably one or more circumferential rows of perforations 24 are formed through the tipping paper 16 at a location along the central component 17 and downstream of the bed of flavored carbon 20, preferably at the upstream end portion of the central component 17 adjacent the carbon bed 20. The preferred placement maximizes distance between the buccal end 9 of the cigarette and the perforations 24, which preferably is at least 12 mm (millimeters) or more so that a smoker's lips do not occlude the perforations 24. Furthermore, because the introduction of diluting air flows at an upstream end portion of the central segment 17, itself, lowers the particulate efficiency of the downstream portions of the segment 17, the upstream location of the ventilation along the filter component 17 facilitates design of the component 17 to provide a more elevated (yet moderate) RTD without a significant elevation of particulate efficiency, so as to help maintain a desired low particulate efficiency in the central component 17 and throughout the filter 14.

Preferably, the level of ventilation is preferably in the range of 40 to 60% and more preferably approximately 45 to 55% in a 6 mg FTC tar delivery cigarette.

It is believed that ventilation not only provides dilution of the mainstream smoke but also effects a reduction of the amount of tobacco combusted during each puff when coupled with a low particulate efficiency filter 14. Ventilation reduces drawing action on the coal and thereby reduces the amount of tobacco that is combusted during a puff. As a result, absolute quantities of smoke constituents are reduced. Preferably, the various filter components (the central filter segment 17, the tobacco end filter segment 18, the carbon bed 20 and month end component 22) are provided low particulate efficiencies and the amount of ventilation is selected such that differences between the desired FTC tar delivery of the cigarette and the output the tobacco rod 12 are minimized. Such arrangement improves the ratio of carbon monoxide content of the delivered smoke to its FTC tar level (CO to Tar ratio). In contrast, prior practices tended to first establish an output level of the tobacco rod 12 and utilized particulate filtration to drive FTC tar delivery down to a desired level. These prior practices tended to combust an excess of tobacco, and accordingly, exhibit higher CO to Tar ratios than typically achieved with the present invention.

Advantageously, the perforations 24 of the present invention are located downstream from the carbon bed 20 so that mainstream smoke velocity through the carbon bed 20 is reduced and dwell time of the main stream smoke amongst the carbon bed 20 is increased. The extra dwell time, in turn, increases the effectiveness of the activated carbon in reducing targeted mainstream smoke constituents. The smoke is diluted by ambient air passing through perforations 24 and mixing with the mainstream smoke to achieve air dilution in the approximate range of 45–65%. For example, with 50% air dilution, the flow through the cigarette upstream of the dilution perforations is reduced 50% thereby reducing the smoke velocity by 50%.

Preferably, the carbon bed comprises at least 90 to 120 mg (milligrams) or greater of carbon in a fully filled condition or 160 to 180 mg or greater of carbon in a 85% filled condition or better in the cavity 19, which in combination with the extra dwell time and flavor release as described above, provides a flavorful cigarette that achieves significant reductions in gas phase constituents of the mainstream smoke, including 90% reductions or greater in 1, 3 butadiene, acrolein, isoprene, propionaldehyde, acrylonitrile, benzene, toluene, styrene, and 80% reductions or greater in acetaldehyde and hydrogen cyanide. The elevated carbon loading also assures an adequate activity level sufficient to achieve such reductions throughout the expected shelf-life of the product (six months or less).

By way of example, the length of tobacco rod 12 is preferably 49 mm, and the length of the multi-component filter 14 m is preferably 34 mm. The length of the four filter components of cigarette 10 in the preferred embodiment is as follows: the tobacco end component 18 is preferably 6 mm; the length of the carbon bed 20 is preferably 12 mm for carbon loading of 180 mg; the central component 17 is preferably 8 mm; and mouth end component 22 is preferably 8 mm. Overall the level of "tar" (FTC) is preferably in the range of 6 mg with a puff count of 7 or greater. All of the components 17, 18, 20 and 22 are of low particulate efficiency, and preferably, amongst all the fibrous or web segments (17, 18 and 22), the tobacco end component 18 is of lowest RTD and particulate efficiency because it is upstream of the ventilation and therefore has greater effect upon the mainstream smoke. Unlike those other fibrous or webbed components, the tobacco end component 18 receives the mainstream smoke in the absence of a diluting air stream.

Tobacco rod 12 may be wrapped with a convention cigarette wrapper or banded paper may be used for this purpose. Banded cigarette paper has spaced apart integrated cellulose bands 21 that encircle the finished tobacco rod of cigarette 10 to modify the mass burn rate of the cigarette so as to reduce risk of igniting a substrate if the cigarette 10 is left thereon smoldering. U.S. Pat. Nos. 5,263,999 and 5,997,691 describe banded cigarette paper, which patents are incorporated herein in their entirety.

Table I below provides details with respect to the various components of cigarette 10 shown in FIG. 1 of the drawing.

| Cigarette | 6 mg FTC Tar. 50% Ventilation |
|---|---|
| Total Cigarette Filter 14: | |
| Filter Length, mm: | 34 |
| Tipping Length, mm: | 38 |
| Filter RTD, mm $H_2O$: | 114 |
| Mouth end Component 22: | |
| Tow Item: | 3.0Y denier/35,000 total denier |
| Component RTD, mm $H_2O$: | 28 |
| Central Component 17: | |
| Tow Item | 1.8Y denier/35,000 total denier |
| Component RTD, mm $H_2O$: | 46 (unventilated)/approx. 30 (ventilated) |
| Tobacco End Component 18: | |
| Tow Item | 5.0Y denier/35,000 total denier |
| Component RTD, mm $H_2O$: | 15 |
| Carbon 20: | |
| Cavity Length, mm: | 12 |
| Weight, mg: | 180 |
| Cavity Component RTD, mm $H_2O$: | 25 |
| Plug Space Plug Subassembly (segment 15, (components 17, 18 and 20)): | |
| Segment RTD, mm $H_2O$: | 86 |

In understanding the above information set forth in Table 1, it is the realized that the preferred RTD of the central component 17 includes an unventilated value and ventilated value, and that with ventilation with central component 17 in accordance with the first preferred embodiment, the RTD of the central component 17 is approximately equal to that of mouth end component 22 or thereabout. Accordingly, a majority of the filter RTD is established downstream of the ventilation, and advantageously such arrangement couples the location of RTD generation with that portion subject to addition of ventilating airflow so that particulate efficiency can be maintained at lower levels, while at the same time contributing a majority of a desired total RTD for the filter.

Preferably, the tobacco end component 18 is that component having the lowest RTD and particulate efficiency because it is upstream of the ventilation and subject to an undiluted stream of mainstream smoke. By such arrangement, the impact of the tobacco end component in removing tar is minimized so that tar output of the tobacco rod is minimized and the amount of tobacco burned per puff is in turn minimized.

In the preferred embodiment, the particulate efficiency for the entire filter 14 is preferably in the range of approximately 40 to 45% as measured under USA/FTC smoking conditions (35 cubic centimeter puff over two seconds).

In the preferred embodiment, it is preferable to load approximately 180 mg of carbon plus or minus approximately 10 mg of carbon to achieve a average 85% fill in a 12 mm cavity at the more traditional cigarette circumferences (approximately 22 to 26 mm). This level of fill together with that amount of carbon will achieve 90% tar weighted reduction of acrolein and 1,3 butadiene relative to an industry standard, machine made cigarette (known as a 1R4F cigarette).

Lower carbon loadings can be utilized to equal effect as one approaches a fully filled condition of 95% or greater. With carbon loadings in the range of 70 to 100 mg and more particularly in the range of 90 to 120 mg compacted, fully filled plug-space-plug filters provide 90% or greater reduction in acrolein and 1,3 butadiene in relation to levels of such in 1R4F cigarettes. Such arrangement provides significant savings in amounts of carbon that may be needed to remove these smoke constituents, and offers substantial savings in costs of manufacture. The compressed and/or fully filled plug-space-plug filter configuration also provides a more consistent performance in gas phase treatment from cigarette to cigarette.

Figure 6:
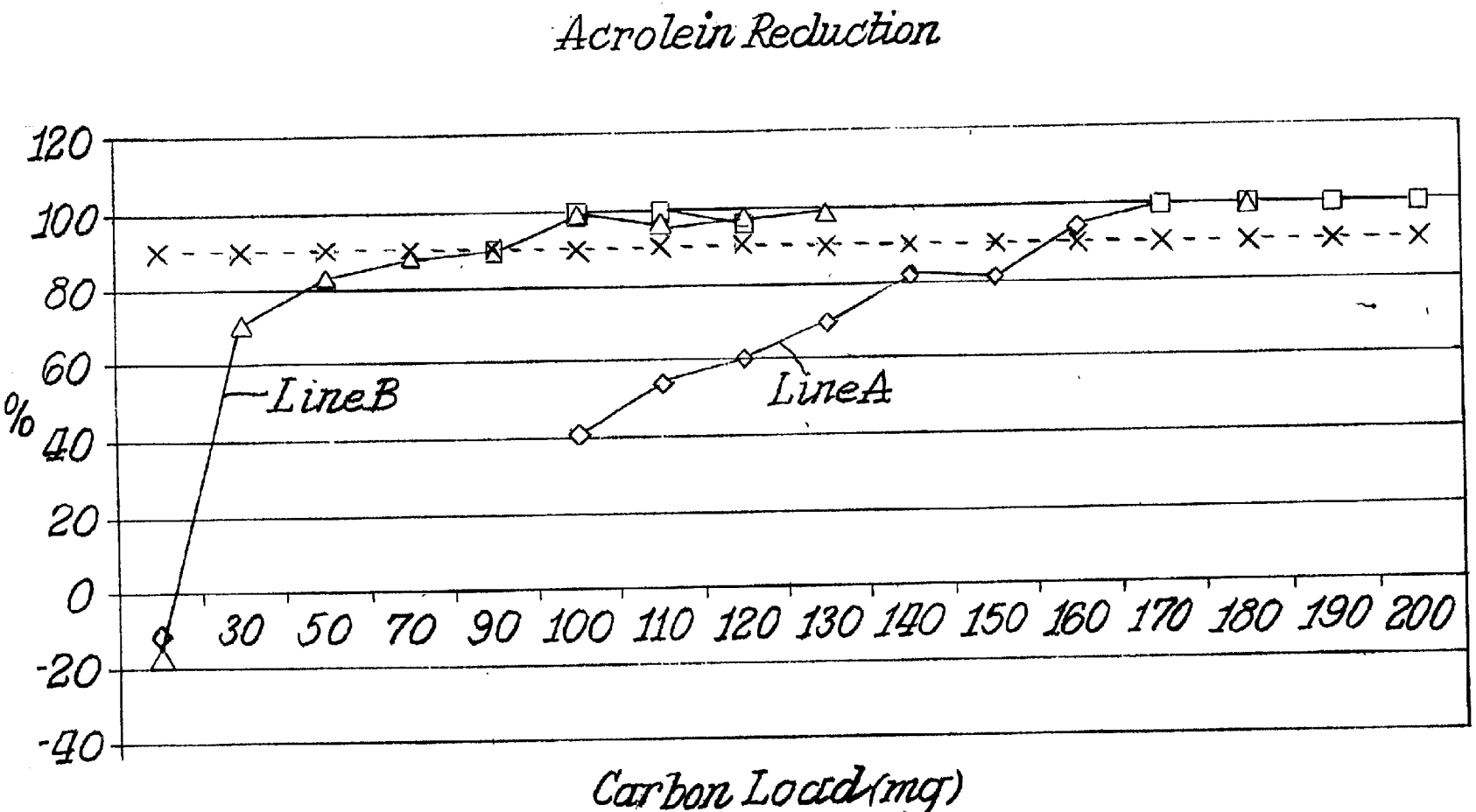
FIG. 6 is a graphical representation of carbon loading versus acrolein reduction with handmade cigarettes constructed in accordance with the preferred embodiment shown in FIG. 1.

In regard to the above and in reference to FIG. 6, Line A is a progression of data points that were established from testing hand-made cigarettes of a design as shown for the preferred embodiment of FIG. 1 and having a cavity 19 of a fixed 10 mm length so that throughout the progression of data points, volume of the cavity 19 remained constant while the amount of carbon loading was increased from 100 mg to approximately 160 mg while moving from left to right along Line A in FIG. 6. The progression indicates that when such a cavity is partially filled with a 100 mg of carbon (a condition wherein substantial space remains unfilled), the effectiveness of the carbon in reducing acrolein is reduced substantially.

In contrast, Line B in FIG. 6 is a progression of data points generated with cigarettes of the construction shown in the preferred embodiment, wherein, cavity space is equal to or approximately equal to carbon volume so that unfilled space is minimized and bypass flows about the carbon bed are avoided. With such change the desired effectiveness of removing acroleins is achievable with carbon loadings in the range of approximately 90 to 100 mg. Contrastingly, the partially filled cavities represented in line A do not achieve a desired 90% or more reduction of acrolein until the cavity is loaded with a much greater amount of carbon, namely 160 mg or more.

Figure 7A:
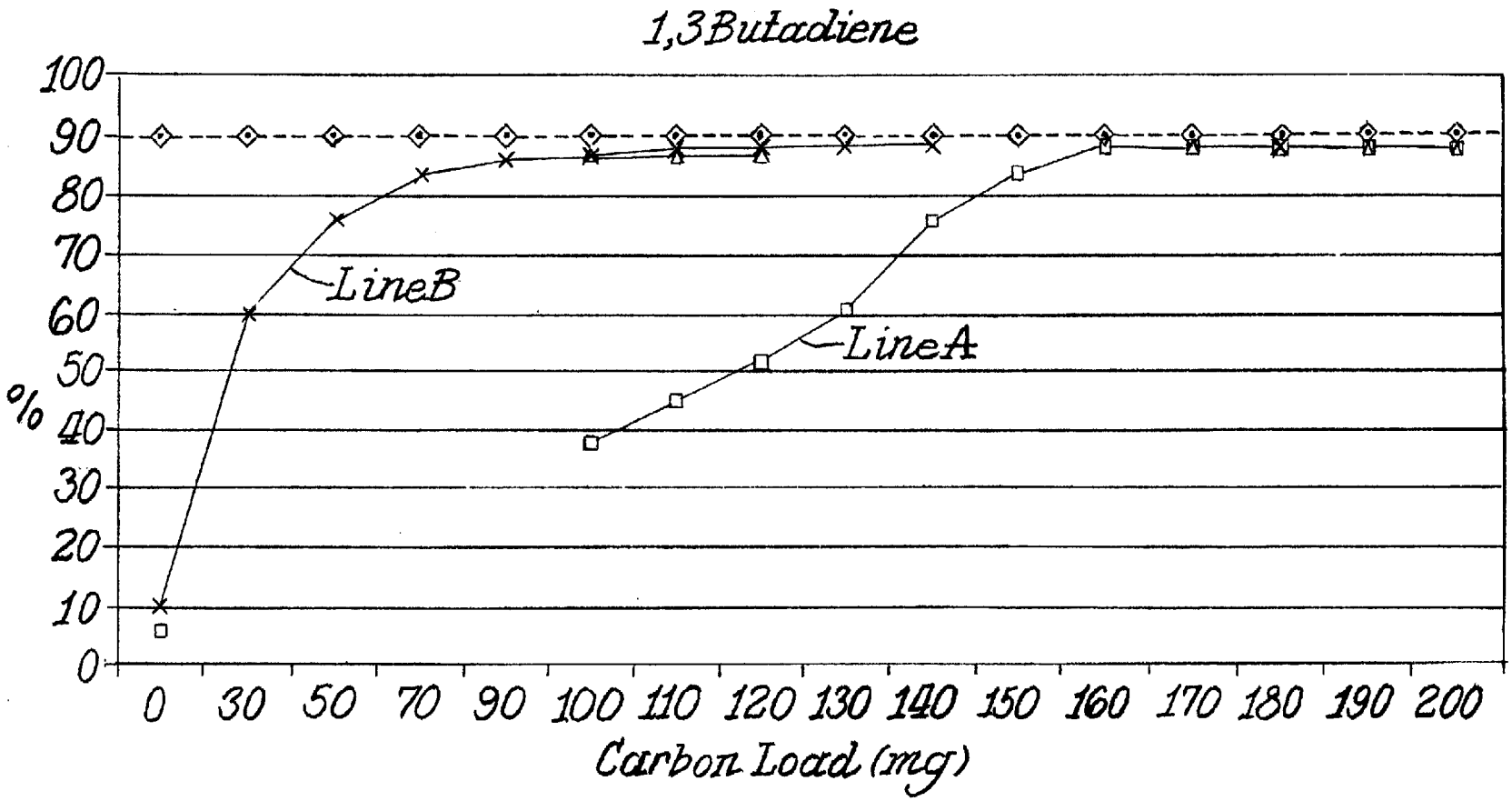
FIG. 7A is graphical representation of carbon loading versus 1, 3 butadiene reduction with handmade cigarettes constructed in accordance with the preferred embodiment shown in FIG. 1.

A similar relationship is shown in FIG. 7A, wherein in Line A represents a progression of data points generated with cigarettes of similar construction to that of the preferred embodiment of FIG. 1, wherein a 10 mm long cavity is maintained at constant volume while ever increasing carbon load is placed in the cavity from 100 mg to approximately 160 mg. Line B in FIG. 7A represents data from cigarettes of similar construction to that of the preferred embodiment but wherein the volume of the cavity is approximately equal to that of the carbon so that unfilled space is minimized and bypass flows are avoided. This data indicates that a filter in a fully filled condition of approximately 80 to 100 mg is adequate for achieving a desired level of reduction in 1,3 butadiene (90% removal or better), whereas such occurs at line A at a substantially great quantity (approximately 160 mg).

The trends exhibited in FIG. 7A at Line A and the supporting data of Line A indicate that on the average a 160 mg carbon loading at approximately 85% fill will achieve approximately a 90% reduction in 1,3 butadiene. It is noted that the supporting test data was generated utilizing a test method whose lower limit of quantification is less than 0.45 micrograms, whereas a 90% reduction of 1,3 butadiene as shown in FIG. 7A equates approximately to 0.42 micrograms of 1,3 butadiene (per calculations). Accordingly, the effectiveness of the carbon loadings near 90% reduction of 1,3 butadiene might actually be greater than a 90% reduction.

Figure 7B:
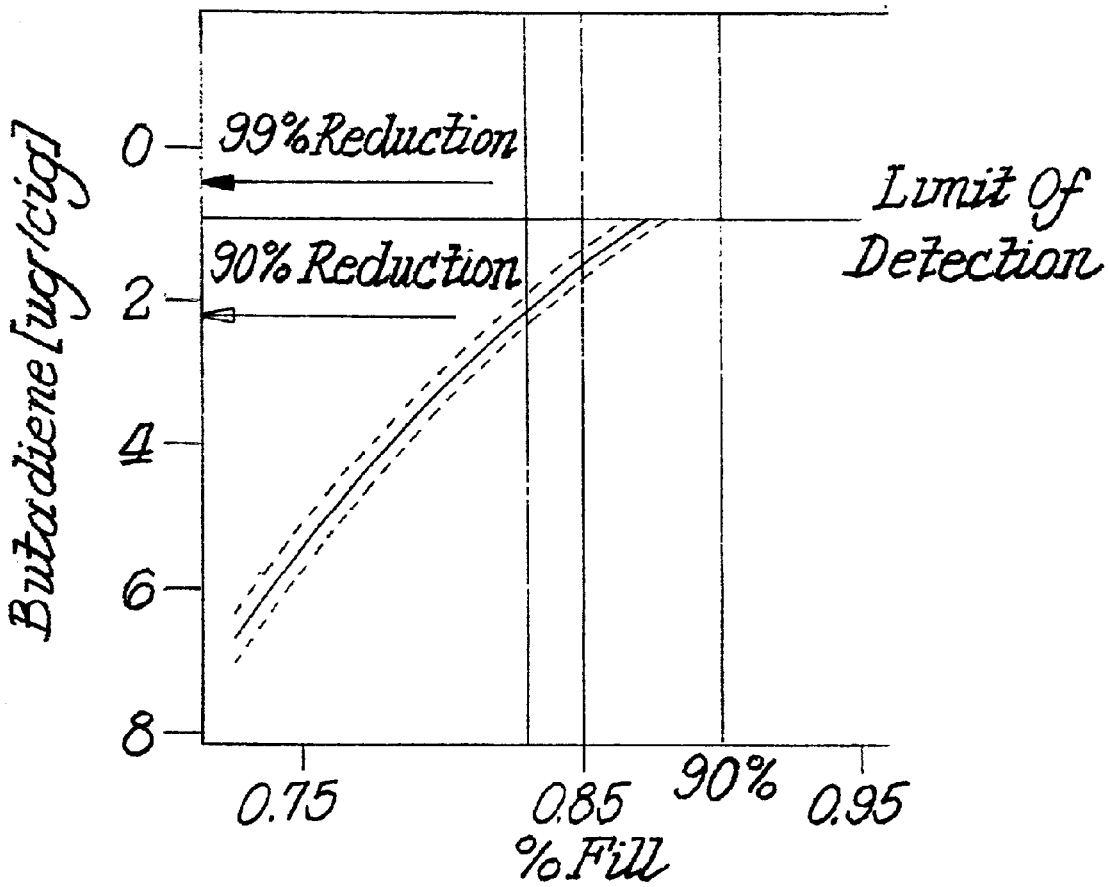
FIG. 7B is graphical representation of carbon loading versus levels of 1, 3 butadiene with machine made cigarettes constructed in accordance with the preferred embodiment shown in FIG. 1 with a 12 mm long cavity.

Referring now to FIG. 7B is graphical representation of carbon loading versus levels of 1,3 butadiene with machine made cigarettes constructed in accordance with the preferred embodiment shown in FIG. 1 with a 12 mm long cavity 19. The fill level was determined using an untamped fill methodology with a gauge cylinder. The trends shown therein indicate that machine made cigarettes constructed with a target fill percentage of 83%, will produce approximately a 90% reduction of 1,3 butadiene in relation to levels of such in 1R4F cigarettes. A target average of 85% or greater percent fill will yield a greater than a 90% reduction of 1,3 butadiene in relation to levels of such in 1R4F cigarettes in a 12 mm cavity, using a high surface area, activated carbon.

Preferably, the high surface area carbon has a specific surface area (square meters per gram) of approximately 1000 square meters per gram or greater.

Smoking tests have been conducted by taste experts with cigarettes that were similar in layout to that of the preferred embodiment shown in FIG. 1. When smoking such cigarettes comprising a flavor yarn element 27 located downstream of an unflavored carbon bed 20, they reported the presence of a flavorful tobacco note during the first several puffs, but that in the latter several puffs, less desirable flavor notes that are recognized as typical of more traditional "charcoal" cigarettes were detected. Additionally, when smoking such test cigarettes comprising a flavored carbon bed 20 but no flavor release element 27 downstream of the flavored carbon bed 20, expert smokers reported that the first several puffs had the less desirable flavor notes typical of more traditional "charcoal" cigarettes, but that after the first several puffs a more flavorful tobacco note was experienced. In contrast, when expert smokers smoked cigarettes of similar construction to that of the preferred embodiment of FIG. 1, including a flavor yarn element 27 located downstream of a bed of flavored carbon 20, they reported a more balanced tobacco smoke throughout all puffs of the test cigarettes.

Not wishing to be bound by theory, it is believed that the filter segments operate together to release flavor into the smoke stream and both sources of flavor provide balance to the aromas and taste of the mainstream smoke throughout a smoking. It is further believed that the bulk of the flavor in central component 17 from the flavor yarn 27 is released early and such release diminishes over time while the flavor released from the carbon bed 20 increases over time with more of the flavor released later in the smoking of the cigarette. Having flavors on both the carbon bed 20 and in or about the central component 17 balance flavor delivery and improve shelf life of the cigarette 10.

In the preferred embodiment of FIG. 1 and the others, the preferred amount of flavorant loading is 3 to 6 mg in the carbon 20, more preferably approximately 4 or 5 mg, and likewise, the preferred amount of flavorant loading is 3 to 6 mg in the yarn 27, more preferably approximately 4 or 5 mg. It is to be understood that reference to a 180 mg loading of flavored carbon herein is inclusive of the flavorant.

Figure 2:
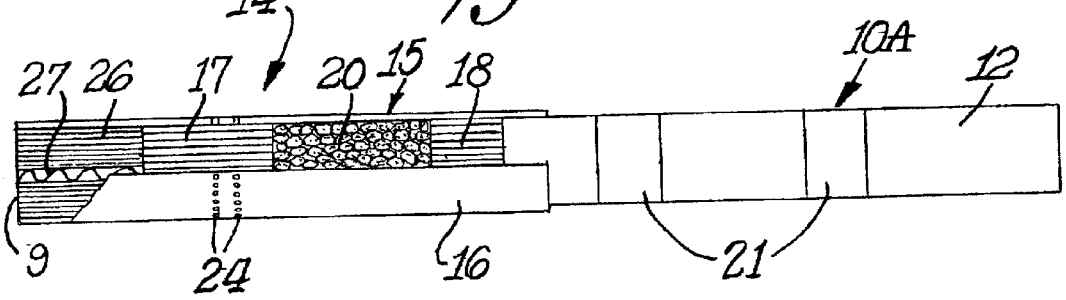
FIG. 2 is a side elevational view of a cigarette comprising a tobacco rod and a multi-component filter, according to the present invention, with portions thereof broken away to illustrate interior details.

Referring now to FIG. 2 another preferred embodiment provides a modified cigarette 10A with the same filter segments as cigarette 10 of FIG. 1, but with a slightly different mutual arrangement of the segments, and similar reference characters are used to identify similar parts. In cigarette 10A the flavor-releasing yarn element 27 is located in the mouth end component 22 at the buccal (mouth) end of the cigarette 10A, downstream from the flavored carbon bed 20 and spaced therefrom by the central component 17. In this embodiment, a plasticizer such as triacetin may be applied to the flavor yarn 27 to hold the yarn in place within component 17 and prevent the yarn from being draw out of the filter during smoking. Alternatively, the flavor yarn 27 may be braided together to achieve the same result. As in the first preferred embodiment, ventilation 24 is provided at a location along the cental filter component 17 adjacent to but downstream of the flavored carbon bed 20.

Table II below provides further details and alternatives with respect to the various components of cigarette 10A of FIG. 2 of the drawing.

TABLE II

| Descriptor | Flavor-Yarn/ Mouth End Component 22 | Adsorbent Bearing Component 17 | Adsorbent Bed 20 | Tobacco End Component 18 | Dilution Perforations 24 |
|---|---|---|---|---|---|
| Length (mm) | 7–9 | 6–8 | 10–14 | 6 | 14 mm from mouth |
| RTD (mm water) | 15–20 | 10–20 | 20–30 | 25–35 | 20–40% vent |
| Material(s) 1 2 | Cellulose Acetate Cotton Thread | Cellulose Acetate | Activated Carbon Coconut, High Surface Area 150–200 mg | Cellulose Acetate Carbon on tow Carbon Paper | Pre Perf |
| Particulate Efficiency | 10–15% | 10–15% | 12–20% | 10–40% | |
| Alternates | CA Thread<br>Flavor on Tow<br>Flavor on Plug Wrap<br>Flavored Plug Wrap | | Impregnated Carbon<br>APS<br>Zeolites<br>"other adsorbents" | | |

It is to be understood that the above characterizations with respect to the second preferred embodiment (FIG. 2) are applicable to those of the first preferred embodiment (FIG. 1), realizing of course, that in the latter embodiment (FIG. 1), the flavor yarn 27 is located in the central filter component 17. The latter arrangement presents a more traditional appearance to the buccal end of the cigarette 10.

Figure 3:
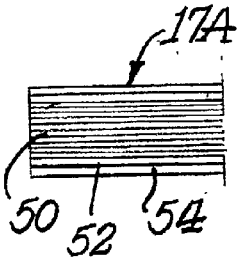
FIG. 3 is a fragmental sectional view of a modified downstream flavor-releasing segment, according to the present invention.

FIG. 3 illustrates an alternate embodiment of the additional flavor-releasing component 17 shown in FIGS. 1 and 2. Specifically, the flavor-releasing component 17A shown in FIG. 3 comprising a cellulose acetate plug 50 of low particulate efficiency surrounded by a plug wrap 52. Combining wrap 54 surrounds to plug wrap as well as the remaining components of the multi-component filter 14 (not shown). Flavor is applied to the plug wrap 52 or to the outside of the cellulose acetate plug 50 for imparting flavor to the cigarette smoke as it passes through plug 50. Alternatively, flavor may be applied to the combining wrap 54 in the area of cellulose acetate plug 50, or the flavor may be incorporated as a component of the plasticizer of plug 50.

Flavor systems may be selected for specific subjective qualities (sweetness, salivation, aroma, and so on) and selected to contain ingredients within a molecular weight range (impacting boiling points, flash points, ambient vapor pressures, and so on) for retention in granulated activated carbon. The flavor system may be stored within an activated carbon of a given specification (granular size, measured activity, ash content, pore distribution, etc.) to allow the flavor system to be released to the cigarette smoke stream in a gradual controlled manner. Not wishing to be bound by theory, it is believed that the flavor system is displaced from the activated carbon by semi-volatile components in the smoke stream that are adsorbed more strongly by the activated carbon. It is believed that these smoke components are generally of higher molecular weights than the ingredients in the flavor system. Because of the different adsorption sights inside the carbon different adsorption energies, and potentials for heats of adsorption, are realized creating a gradual release of the flavor system as more and more of the semi-volatile smoke components are adsorbed.

Not wishing to be bound by theory, the present invention utilizes the observable phenomenon that activated carbon (or other adsorbent) bearing a first adsorbate of a low heat of adsorption will release a fraction of the first adsorbate in the presence of a second adsorbable agent having a greater heat of adsorption. It is believed that even with highly loaded activated carbon, some activity sites in the carbon are yet, still available for adsorption of the second adsorbable agent, and when such is adsorbed, the released heat of adsorption is available to release a fraction of the first absorbent from the carbon. More particularly, in the context of the present invention, the activated carbon 20 is at first loaded with a flavorant, which preferably has a sufficiently low heat of adsorption in relation to heats of adsorption of organic gas constituents of mainstream smoke. It is believed that the present invention utilizes interaction between remaining activity sites in the flavorant-bearing carbon 20 and the organic gas constituents of passing mainstream smoke that have the higher heats of adsorption to produce heat which drives off (releases) a fraction of the flavorant into the passing mainstream smoke.

Figure 4:
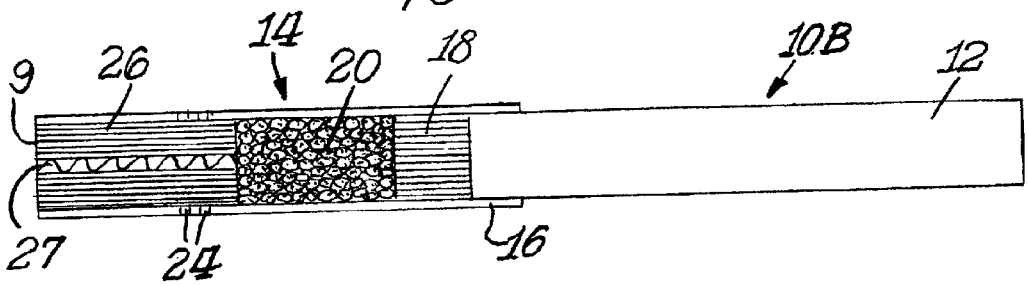
FIG. 4 is a side elevational view of still another cigarette comprising a tobacco rod and multi-component filter, according to the present invention, with portions broken away to show interior details.

FIG. 4 shows another cigarette 10B comprising a tobacco rod 12 and a multi-component filter 14 attached to the rod with tipping paper 16. Filter 14 comprises a plug-space-plug, carbon filled type of filter segment 15 wherein a generous bed of flavored carbon material 20 is disposed between first and second filler plugs 18, 26. Preferably, the plugs 18 and 26 each comprises a cellulose acetate tow of low particulate efficiency, and tow 26 includes one or more flavor-bearing yarns 27. Also, cellulose acetate plug 18 may be sprinkled with carbon, if desired.

The activated carbon material 20 serves as an adsorbent of smoke constituents of mainstream smoke, for example aldehydes, ketones and other volatile organic compounds. The activated carbon material may have the flavorant on the surface thereof and such flavoring is released into mainstream smoke during smoking of cigarette 10B.

Perforations 24 at or about plug 26 provide both dilution of the mainstream smoke by ambient air and a reduction of the amount of tobacco combusted during each puff. Ventilation reduces production and delivery of particulate (tar) and gas phase (co) constituents during a puff.

Figure 5:
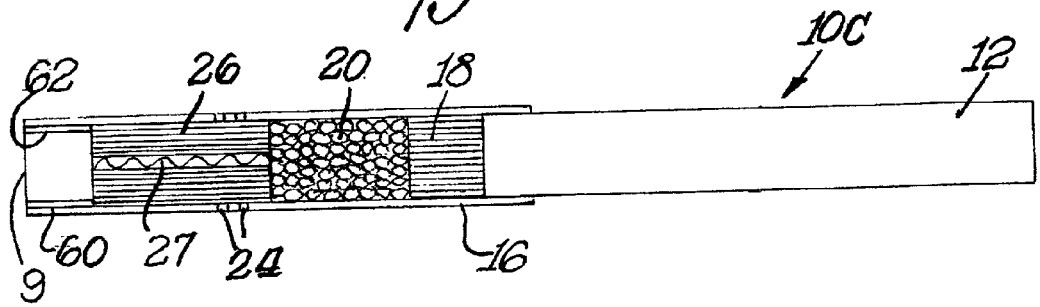
FIG. 5 is a side elevational view of another cigarette comprising a tobacco rod and a multi-component filter according to the present invention, with portions broken away to show interior details.

FIG. 5 shows a cigarette 10C very similar to the cigarette 10B illustrated in FIG. 4, and similar reference characters have been used to identify similar parts. However, cigarette 10C is recessed at the buccal end 60, and heavy tipping paper 62 may be utilized.

FIG. 8 illustrates another cigarette 10D of the present invention where components similar to those of cigarette 10A (FIG. 2) are identified with similar reference numerals. Cigarette 10D also includes a multi-component filter 14D but an RTD filter plug 30 is used in place of the second cellulose tow 22 of cigarette 10A. Filter plug 30 is positioned between the activated carbon material 20 and flavor-releasing component 17, and the plug 30 may comprise an impervious hollow plastic tube closed by crimping at the upstream end thereof. U.S. Pat. No 4,357,950, describes such a plug, which patent is hereby incorporated herein by reference, in its entirety. In the alternative, such filter components may be obtained from the aforementioned American Filtrona Company of Richmond, Va. As a result of filter plug 30, a transition region 32 is provided from a generally circular cross-sectional region 34 of activated carbon material 20 having a low pressure drop to a generally annular cross-sectional region 36 having a high pressure drop. This transition region and the downstream location of perforations 24 results in high retention or residence times for the mainstream smoke upstream of the perforations. As a result, favorable reduction in gas phase components is achieved per puff of cigarette 10D, along with favorable dilution by ambient air and acceptable drawing characteristics. Flavor is released to the diluted mainstream smoke as it passes through the flavor-releasing component 17. As in the other preferred embodiments, it is preferred that the adsorbent bed 20 comprises a flavor-bearing, activated carbon.

By way of example, the length of tobacco rod 12 of cigarette 10D may be 45 mm, and the length of multi-component filter 14D may be 38 mm. The length of the four filter segments of filter 14D is as follows: cellulose acetate tow 18 is 6 mm; carbon material length is 10 mm; filter plug 30 is 14 mm; and the flavor-releasing component 17 is 8 mm. Overall, the level of FTC tar may be 4 to 10 mg.

The filter plug 30 may also include a low efficiency cellulose acetate tow 38 on the outside thereof. The transition 32 from the generally circular cross-section 34 to the generally annular cross-section 36 and the downstream location of the air dilution perforations 24 increases the pressure drop and increases the retention time of the smoke in contact with the carbon in the filter plug 20. The smoke is diluted by air passing through perforations 24 and mixing with the smoke to achieve air dilution in the approximate range of 45–65%. For example, with 50% air dilution, the flow through the cigarette upstream of the dilution perforations is reduced 50% thereby reducing the smoke velocity by 50% which basically increases the dwell time in the filter plug 20 by a factor of two. This embodiment of the multi-component filter positions the maximum amount of carbon material upstream of the air dilution perforations 24.

A crimped plastic tube has been used in cigarette 10D as a member which is substantially impervious to gas or vapor phase components for affecting a transition from a high retention time region to a high pressure drop region. It is contemplated that other shapes, such as conical or blunt ends can be used. In addition, a solid member, such as one made of high density (and hence impervious) cellulose acetate tow or a solid rod can also be used such as shown in FIG. 9, for example, and described below. Other impervious membrane structures are also contemplated.

Also, as noted above tobacco rod 12 may be wrapped with convention paper or banded paper may be used for this purpose. Banded cigarette paper has spaced apart integrated cellulose bands that encircle the finished tobacco rod of cigarette 10D to modify the mass burn rate of the cigarette. Additionally, an absorbent-bearing component may be used alone or in combination with the adsorbent-bearing segment 15 of multi-component filter 14D if desired.

Table III below provide further details and alternatives with respect to the various components of cigarette 10D illustrated in FIG. 8 of the drawing.

TABLE III (FIG. 8 Components)

| | Mouth End Component 26 | RTD Producing Component 30 | Adsorbent Bed 20 | Tobacco End Component 18 | Dilution Perforations 24 |
|---|---|---|---|---|---|
| Length (mm) | 6–8 | 14–16 | 10–12 | 6 | 19 mm from mouth |
| RTD (mm water) | 15–20 | 70–80 | 20–30 | 15–20 | 40–65% vent |
| Particulate Efficiency | 10–15% | 15–20% | 15–20% | 10–20% | |
| Material(s) | Cellulose Acetate Cotton Thread | COD* RTD Producer | Activated Carbon Coconut High Surface Area 120–180 mg | Cellulose Acetate Carbon on tow Carbon Paper | Pre Perf |
| Alternates | CA Thread | Concentric Core | Impregnated Carbon | | |
| | Flavor on Tow | TWA** | APS | | |
| | Flavor on Plug Wrap | Tube in Tow | Zeolites | | |
| | Flavored Plug Wrap | | "other adsorbents" | | |

*COD = Carbon Monoxide Dilution

**TWA (Thin Wrapped Acetate) See U.S. Pat. Nos. 4,614,199 and 4,675,064, incorporated herein by reference Cellulose Acetate All deniers range from 3.0–8.0 dpf for all above filter plugs.

FIG. 9 illustrates another cigarette 10E of the present invention and components similar to those of cigarette 10D are identified with similar reference numerals. Cigarette 10E also includes a multi-component filter 14E but a concentric core filter plug 40 is used in place of the "COD" or carbon monoxide dilution filter plug 30 of cigarette 10D. Filter plug 40 is positioned between the activated carbon material 20 and flavor releasing component 17, and the plug 40 may comprise a highly impervious solid cylindrical rod 42 surrounded by a low efficiency cellulose acetate tow 44 on the outside thereof. As a result of filter plug 40 a sharp transition region is provided from a generally circular cross-sectional region of activated carbon material 20 having a low pressure drop to a generally annular cross-section region having a high pressure drop. This transition and the downstream location of perforations 24 results in high retention or residence times for the mainstream smoke upstream of the perforations, as explained above with respect to cigarette 10D of FIG. 8.

By way of example, the length of tobacco rod 12 of cigarette 10E may be 45 mm, and the length of multi-component filter 14E may be 38 mm. The length of the four filter components of filter 14E is as follows: cellulose acetate tow 18 is 6 mm; carbon material length is 10 mm; filter plug 40 is 14 mm; and the flavor-releasing component 17 is 8 mm. Overall, the level of "tar" may be 4 to 10 mg.

In cigarette 10E, the smoke is diluted by air passing through perforations 24 and mixing with the smoke to achieve air dilution in the approximate range of 45 to 65%. As in the case of cigarette 10D, with 50% air dilution, the flow through cigarette 10E upstream of the dilution perforations is reduced by 50% thereby reducing the smoke velocity by 50% which basically increases the dwell time in the filter plug 20 by a factor of two.

Tobacco rod 12 of cigarette 10E may be wrapped with conventional or banded paper, as described above, and an absorbent-bearing segment may be used alone or in combination with the adsorbent bearing segment 15 of multi-component filter 14E, if desired.

Alternatively, the concentric filter plug 40 may be constructed so that the flow therethrough is essentially through the core with limited flow through the annular space outside the core.

FIG. 10 illustrates an alternate embodiment of the flavor releasing component 17 shown in FIGS. 8 and 9. Specifically, the flavor-releasing component 17' shown in FIG. 10 comprises a cellulose acetate plug 50 of low particulate efficiency surrounded by a plug wrap 52. Combining wrap 54 surrounds to plug wrap as well as the remaining components of the multi-component filter. Flavor is applied to the plug wrap 52 or to the outside of the cellulose acetate plug 50 for imparting flavor to the cigarette smoke as it passes through plug 50. Alternatively, flavor may be applied to the combining wrap 54 in the area of cellulose acetate plug 50, or the flavor may be incorporated as a component of the plasticizer of plug 50.

FIG. 11 illustrates another cigarette 10F of the present invention and components similar to those of cigarette 10E are identified with similar reference numerals. Cigarette 10F includes a multi-component filter 14F that comprises an upstream adsorbent bearing segment 15 adapted to remove one or more smoke constituents from mainstream smoke passing therethrough, and a downstream flavor-releasing component 17 for releasing flavor into mainstream smoke passing therethrough.

Flavor-releasing component 17 of cigarette 10F is different in that it comprises a filter plug 40 positioned downstream of the activated carbon material 20. Plug 40 comprises a relatively or highly impervious solid cylindrical rod 42 surrounded by a low efficiency cellulose acetate tow 44, and the construction and function of plug 40 is similar to that shown in FIG. 9. However, the plug 40 shown in FIG. 11 includes flavor on the combining wrap 54 which is released onto the mainstream smoke flowing through component 17.

By way of example, the length of tobacco rod 12 of cigarette 10F may be 45 mm, and the length of multi-component filter 14F may be 38 mm. The length of the three filter components of filter 14F is as follows: cellulose acetate tow 18 is 6 mm; carbon material length is 16 mm; and the plug 40 is 16 mm. Overall the tar level may be 4 to 10 mg.

In cigarette 10F, the smoke is diluted by air passing through perforations 24 and mixing with the smoke to achieve air dilution in the approximate range of 45 to 65%. Such dilution also serves to increases the dwell time of the smoke amongst the carbon granules 20, as explained above.

One or more rows of perforations 24 at or about the plug 40 provide both dilution of the mainstream smoke by ambient air and a reduction of the amount of tobacco combusted during each puff. Ventilation reduces production and delivery of particulate (tar) and gas phase (CO) constituents during a puff.

The additional flavor-releasing component 17 of the multi-component filter 14, 14D, 14E preferably comprises a plug 26 of cellulose acetate tow of low particulate efficiency together with one or more flavor-bearing threads or tapes 27. Plug 26 is located at the mouth or buccal end of the cigarettes shown in FIGS. 2, 4, 5, 8 and 9 in a downstream position. As the mainstream tobacco smoke is drawn through the threads or tapes 27 flavoring is released into the smoke to produce a desired effect. As noted above, U.S. Pat. No. 4,281,671, incorporated herein by reference, describes tobacco smoke filters that include threads and tapes with flavoring materials.

While this invention has been illustrated and described in accordance with preferred embodiments, it is recognized that variations and changes may be made therein without departing from the invention as encompassed in the claims. In that regard, the plug-space-plug segment 15 or the carbon bed 20 might be replaced with an agglomerated carbon element or other form of adsorbent that is adapted to remove gas phase components from mainstream smoke. In this regard, the carbon bed may also comprise a combination of carbon and fibers. Also, the plug components might be constructed of filter materials other than those specifically mentioned herein. The ventilation might be constructed using known on-line or off-line techniques.

Moreover, the present invention may be practiced with cigarettes of various circumferences, narrow cigarettes as well as wide. Also, while the present invention is preferably practiced with unflavored tobacco rods, flavored tobacco material is also contemplated.

What is claimed is:

1. A cigarette comprising a tobacco rod and a multi-component filter comprising a bed of adsorbent particles and ventilation at a location downstream of said bed of adsorbent particles, said bed of adsorbent particles and ventilation constructed and arranged to substantially remove of at least one smoke constituent from mainstream tobacco smoke as mainstream smoke is drawn through the filter, and at least one flavor-releasing component constructed and arranged to release flavor to mainstream smoke, the flavor-releasing filter component being located downstream of the said bed of adsorbent particles in a direction of mainstream smoke drawn through the filter.

2. The cigarette as in claim 1, wherein said bed of adsorbent particles includes a flavorant-bearing, activated carbon.

3. The cigarette as in claim 2, wherein the flavor-releasing component includes a cellulose acetate plug with flavorant thereon.

4. The cigarette as in claim 2, wherein the flavor-releasing component includes a cellulose acetate plug surrounded by plug wrap with flavorant on the plug wrap.

5. The cigarette as in claim 2, wherein the flavor-releasing filter component includes a flavorant-bearing filament and surrounding cellulose located downstream of said flavorant-bearing, activated carbon.

6. The cigarette as in claim 5, wherein said bed of adsorbent particles is disposed in a cavity defined between a tobacco end filter component and a central filter component, said cavity in a condition of being at least 85% filled.

7. The cigarette as claimed in claim 6, wherein said tobacco end filter component is located adjacent said tobacco rod, and said central filter component having an end portion adjacent said bed of adsorbent particles, said ventilation at a location along said adjacent upstream end portion of said central filter component.

8. The cigarette as in claim 7, wherein said ventilation is in the range of 45 to 55%, and wherein said multi-component filter further comprises a mouth end filter component downstream of said central filter component.

9. The cigarette as in claim 8, wherein said tobacco end filter segment, said central fitter component, said bed of adsorbent particles and said mouth end filter component are of low particulate filtration efficiency.

10. The cigarette as in claim 9, wherein the level of resistance to draw of said mouth end component and said central filter component is greater than the resistance to draw of said tobacco end filter component.

11. The cigarette as in claim 10, wherein said ventilation comprises a circumferential row of perforations through a tipping paper, said tipping paper attaching said multi-component filter to said tobacco filter rod.

12. The cigarette as in claim 11, wherein said ventilation is located at least 12 mm from a buccal end of the cigarette.

13. The cigarette as in claim 5, wherein the bed of adsorbent particles comprises activated carbon of at least 90 mg in a fully filled condition.

14. The cigarette as in claim 5, wherein the bed of adsorbent particles comprises a high surface area activated carbon; at least 90 to 120 mg or greater of said carbon in a fully filled condition or 160 to 180 mg or greater of said carbon in a 85% filled condition or better.

15. The cigarette as in claim 5, wherein the bed of adsorbent particles comprises a high surface area activated carbon of at least 90 to 120 mg in fully filled condition.

16. The cigarette as in claim 1, wherein the multi-component filter includes a component in the form of a plug defining a flow path with a transition from generally circular to generally annular to thereby produce an increased pressure drop and increased dwell time of mainstream tobacco smoke in the filter.

17. The cigarette as in claim 1, wherein the multi-component filter includes a component in the form of a plug providing a flow constriction downstream of the bed of adsorbent particles.

18. The cigarette as in claim 17, wherein the plug providing the flow constriction downstream of the bed of adsorbent particles defines an annular flow path.

19. The cigarette as in claim 17, wherein the plug providing the flow constriction downstream of the bed of absorbent particles defines a central flow path.

20. The cigarette as in claim 17, wherein the plug providing the flow constriction downstream of the bed of adsorbent particles comprises a concentric filter.

21. A multi-component filter of a smoking article comprising:

an absorbent bearing segment adjacent an upstream end portion of the filter, the absorbent bearing segment including a bed of adsorbent particles and having a particulate efficiency in the range 10–20% and a lesser RTD;

an RTD-inducing segment including a flow constriction and ventilation, the RTD-inducing segment being located at an intermediate location along said filter, the RTD-inducing segment having a particulate efficiency in the range of 10–20%; and a flavor releasing segment at a downstream location along said filter, said flavor releasing segment having a particulate efficiency in the range 10–20% and a lesser RTD;

the lesser RTD being less than an RTD of the RTD inducing segment.

22. The multi-component filter as in claim 21, wherein the ventilation is adjacent an upstream end portion of the RTD-inducing segment.

23. A cigarette comprising a tobacco rod and a multi-component filter comprising at least one adsorbent-bearing flavor-releasing segment including a bed of flavored adsorbent particles constructed and arranged to release flavor into mainstream tobacco smoke and to remove at least one smoke constituent from mainstream tobacco smoke as mainstream smoke is drawn through the filter, and at least one additional flavor-releasing segment constructed and arranged to release added flavor to mainstream smoke, the additional flavor-releasing segment being located downstream of the adsorbent-bearing flavor-releasing segment in a direction of mainstream smoke drawn through the filter.

24. The cigarette as in claim 23, wherein the additional flavor-releasing segment includes yarn with flavorant thereon and surrounding cellulose acetate.

25. The cigarette as in claim 23, wherein the bed of flavored adsorbent particles comprises activated carbon with flavorant on the carbon.

26. The cigarette as in claim 25, wherein the adsorbent-bearing flavor-releasing segment includes three filter components including the activated carbon with flavorant on the carbon and cellulose acetate tow components on opposite sides of the activated carbon.

27. The cigarette as in claim 23, including tipping paper surrounding the multi-component filter, and perforations in the tipping paper downstream from the adsorbent-bearing flavor-releasing segment tar introducing ambient air into mainstream tobacco smoke drawn through the filter.

28. The cigarette as in claim 23, wherein the additional flavor-releasing segment includes a cellulose acetate plug with flavorant thereon.

29. The cigarette as in claim 23, wherein the additional flavor-releasing segment includes a cellulose acetate plug surrounded by plug wrap with flavorant on the plug wrap.

30. The cigarette as in claim 23, wherein the the bed of flavored absorbent particles comprises carbon particles with flavorant on the carbon.

31. The cigarette as in claim 23, wherein the bed of flavored absorbent particles comprises carbon particles with flavorant on the carbon including at least 90 to 120 mg or greater of said carbon in a fully filled condition or 160 to 180 mg or greater of said carbon in a 85% filled condition or better.

32. A cigarette comprising a tobacco rod and a multi-component filter comprising:

a bed of adsorbent particles and a flavor-releasing filter segment located downstream of the bed of adsorbent particles, said bed of adsorbent particles being flavor-bearing and comprising high surface area, activated carbon so that as mainstream smoke is drawn through the upstream portion of the filter, gas phase smoke constituents are removed and flavor is released from the bed of adsorbent particles and thereafter additional flavor is released into the mainstream smoke as it passes through the flavor-releasing filter segment;

filter ventilation arranged at a location spaced downstream from the adsorbent bed of adsorbent particles so as to lower mainstream smoke velocity through the adsorbent bed; and said carbon bed comprising at least 90 to 120 mg or greater of said carbon in a fully filled condition or 160 to 180 mg or greater of said carbon in a 85% filled condition or better, wherein said cigarette achieves a significant reduction in a gas phase constituent of the mainstream smoke.

33. The cigarette as in claim 32, wherein the cigarette achieves significant reductions in gas phase constituents of mainstream smoke, including 90% reductions or greater in at least one of 1, 3 butadiene, acrolein, isoprene, propionaldehyde, acrylonitrile, benzene, toluene and styrene.

34. The cigarette as in claim 32, wherein the cigarette achieves significant reductions in gas phase constituents of the mainstream smoke, including 80% reductions or greater in at least one of acetaldehyde and hydrogen cyanide.

35. A cigarette comprising a tobacco rod and a multi-component filter comprising:

a bed of adsorbent particles comprising a high surface area, activated carbon so that as mainstream smoke is drawn through the upstream portion of the filter, gas phase smoke con constituents are removed;

filter ventilation arranged at a location spaced downstream from the adsorbent bed of adsorbent particles so as to lower mainstream smoke velocity through the adsorbent bed; and said carbon bed comprising at least 90 to 120 mg or greater of said carbon in a fully filled condition or 160 to 180 mg or greater of said carbon in a 85% filled condition or better; and said filter ventilation being spaced from a mouth end of said cigarette by at least approximately 12 mm;

wherein said cigarette achieves a significant reduction in a gas phase constituent of the mainstream smoke.

36. A multi-component cigarette filter comprising at least one adsorbent-bearing flavor-releasing segment including a bed of flavored adsorbent particles constructed and arranged to release flavor into mainstream tobacco smoke and to remove at least one smoke constituent from mainstream tobacco smoke, end at least one additional flavor-releasing segment constructed and arranged to release added flavor to mainstream smoke, the additional flavor-releasing segment being located downstream of the adsorbent-bearing flavor-releasing.

37. The filter as in claim 36, wherein the additional flavor-releasing segment includes yarn with flavorant thereon and surrounding cellulose acetate.

38. The filter as in claim 36, wherein the bed of flavored adsorbent particles includes activated carbon with flavorant on the carbon.

39. The filter as in claim 38, wherein the adsorbent-bearing flavor-releasing segment includes three filter components including the activated carbon with flavorant on the carbon and cellulose acetate tow components on opposite sides of the activated carbon.

40. The filter as in claim 38, wherein the additional flavor-releasing segment includes a cellulose acetate plug with flavorant thereon.

41. The filter as in claim 36, wherein the additional flavor-releasing segment includes a cellulose acetate plug surrounded by plug wrap with flavorant on the plug wrap.

42. The filter as in claim 36, wherein the bed of flavored adsorbent particles comprises carbon particles with flavorant on the carbon.

43. The filter as in claim 42, wherein the bed of carbon particles includes at least 90 to 120 mg or greater of said carbon in a fully filled condition or 160 to 180 mg or greater of said carbon in a 85% filled condition or better.

44. A cigarette comprising a tobacco rod and a filter, the filter comprising:

a first filter plug adjacent the tobacco rod;

a second filter plug in a spaced apart and downstream relation to said first filter plug so as to define a cavity therebetween, said second filter plug including a flavor-bearing filament and ventilation perforations;

a bed of adsorbent particles in the cavity, said adsorbent comprising activated carbon particles in an amount of 160 to 180 mg or greater in the cavity, with said cavity in an 85% filled condition or better, said activated carbon particles being flavor-bearing; and a third, mouth piece filter plug located downstream from said second filter plug, said first, second and third filter plugs being essentially free of carbon particles;

wherein said filter removes at least 90% of at least one of 1, 3 butadiene, acrolein, isoprene, propionaldehyde, acrylonitrile, benzene, toluene and styrene from mainstream smoke as the smoke is drawn through said filter, said fitter releasing flavor into mainstream smoke as the smoke is drawn through the bed and the second plug of the filter.

* * * * *

UNITED STATES PATENT AND TRADEMARK OFFICE

CERTIFICATE OF CORRECTION

PATENT NO. : 6,761,174 B2
DATED : July 13, 2004
INVENTOR(S) : Jupe et al.

It is certified that error appears in the above-identified patent and that said Letters Patent is hereby corrected as shown below:

Column 15,
Line 65, after “remove” delete “of”

Column 16,
Line 16, after “cellulose” insert -- acetate --.
Line 34, “fitter” should read -- filter --.

Column 17,
Line 57, “tar” should read -- for --.

Column 18,
Line 44, after “smoke” delete “con”.
Line 46, before “bed” delete “adsorbent”.

Column 44,
Line 20, “fitter” should read -- filter --.

Signed and Sealed this

Twenty-third Day of November, 2004

JON W. DUDAS
*Director of the United States Patent and Trademark Office*